United States Patent [19]

Buttler

[11] 4,015,868

[45] Apr. 5, 1977

[54] DOOR LOCK EMPLOYING INTERLOCKING HINGE PLATES

[75] Inventor: Carl T. Buttler, Glendale, Ariz.

[73] Assignee: Kenneth E. Marquis, Phoenix, Ariz.

[22] Filed: Feb. 12, 1976

[21] Appl. No.: 657,445

[52] U.S. Cl. ..... 292/302

[51] Int. Cl.² ..... E05C 1/04

[58] Field of Search ..... 292/302, 264, 150, DIG. 9

[56] References Cited

UNITED STATES PATENTS

| | | | |
|---|---|---|---|
| 1,659,822 | 2/1928 | Innes | 292/302 X |
| 1,924,627 | 8/1933 | Segal | 292/264 |
| 2,105,714 | 1/1938 | West | 292/264 |

*Primary Examiner*—Richard E. Moore
*Attorney, Agent, or Firm*—Warren F. B. Lindsley

[57] ABSTRACT

A lock assembly employing cooperating hinge plates interlocked with a removable bolt to prevent the non-hinged edges of a locked panel or door from moving away from its panel or door jambs.

2 Claims, 10 Drawing Figures

DOOR LOCK EMPLOYING INTERLOCKING HINGE PLATES

BACKGROUND OF THE INVENTION

This invention relates to door locking means and more particularly to a door locking means associated with the swinging side of a panel or door which prevents unauthorized opening of the panel or door by jimming of its latch bolt or removal of the stud from the hinges of the panel or door.

DESCRIPTION OF THE PRIOR ART

Heretofore, attempts have been made to prevent the intrusion of a tool or other device between the edge of a locked door and its jamb at the location where the door bolt enters a socket catch on the jamb so that the bolt cannot be manipulated by the tool to permit an opening of the door when locked. These prior attempts have not been successfully marketed since either they were not effective or were too costly to manufacture and sell. Further, sliding bolt locks have been used on the interior of a door by supplementing the normal door locking mechanisms but these have been unsightly and many times marred the finish of the door.

SUMMARY OF THE INVENTION

In accordance with the invention claimed, a new and improved locking assembly is provided having hinge type plates which interlock in door closed position to prevent successful jimming of the latch bolt for permitting the door to be moved away from its door jamb.

It is, therefore, one object of this invention to provide a new and improved locking device for hinged doors or panels.

Another object of this invention is to provide a new and improved locking assembly which negates the effective unauthorized movement of the latch bolt of a door locking mechanism.

A further object of this invention is to provide a new hinge plate assembly which cooperates in door or panel closed position to prevent door or panel movement and may be partially consealable between the door or panel and its door jamb.

Further objects and advantages of the invention will become apparent as the following description proceeds and the features of novelty which characterize this invention will be pointed out with particularly in the claims annexed to and forming part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
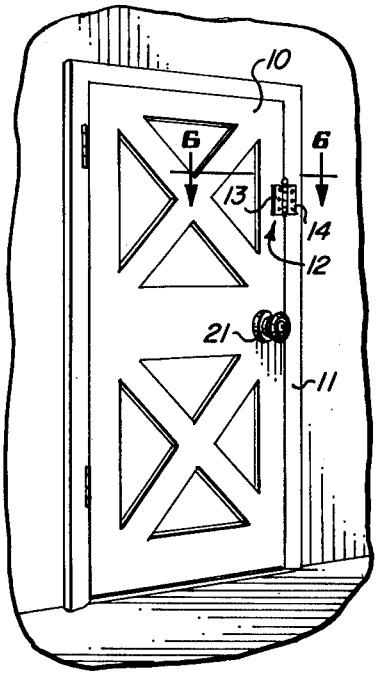
FIG. 1 is a perspective view of a door and door jamb illustrating the leaf type plates of the door locking means mounted on the door and door jamb and embodying the features of this invention.

Referring more particularly to the drawing by characters of reference, FIG. 1 discloses a perspective view of a door 10 and associated door jamb 11 on the door latching and locking side of the structure. It should be recognized that even though a door and associated door jamb have been illustrated, these structures are intended to be symbolic of any door, door jamb, panel and panel frame wherein an opening is closed by a pivotally mounted member.

Figure 2:
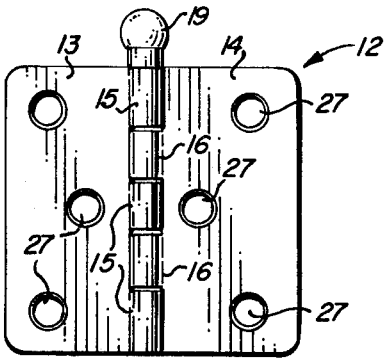
FIG. 2 is a front view of the door locking mechanism shown in FIG. 1 in door locking position.
Figure 9:
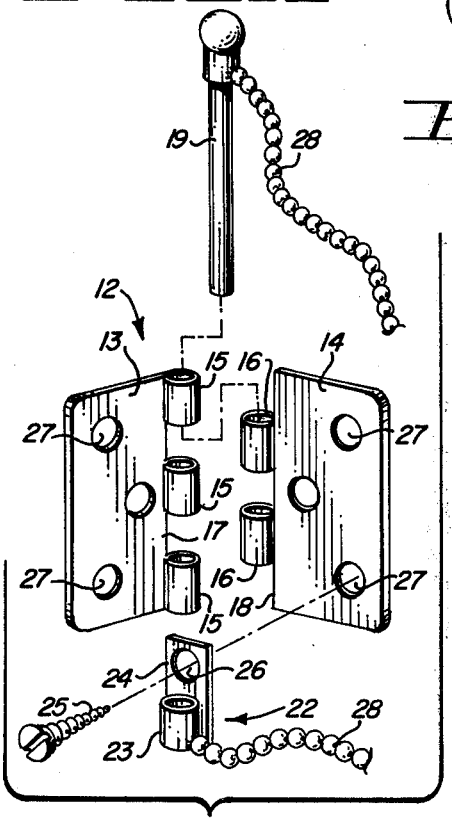
FIG. 9 is an exploded view of the leaf plates of the door locking means shown in FIG. 1.

As shown in FIG. 1, 2 and 9, the door 10 has mounted on it and its door jamb 11 a new locking means 12 comprising a pair of leaf type plates 13 and 14 each of which are formed to provide ears or end lug positions 15 and 16 along juxtapositioned edges 17 and 18 which axially align to provide a passageway for a stud or pin 19.

Figure 6:
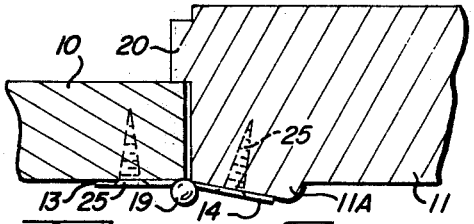
FIG. 6 is a partial cross-sectional view of the locking means, door and door jamb shown in FIG. 1 taken along the line 6—6.
Figure 7:
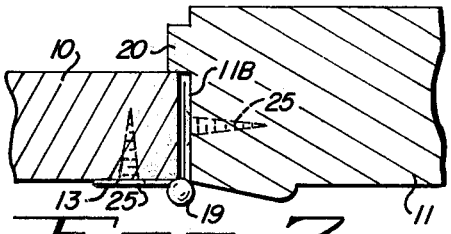
FIGS. 7 and 8 are partial cross-sectional views of the locking means shown in FIGS. 1 and 6 showing other ways of mounting the locking means.
Figure 8:
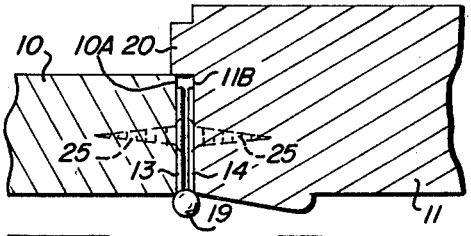

As shown in FIGS. 6–8, the door 10 closes against a stop piece 20 forming a part of the door jamb 11. In practice, however, the door does not always seat tightly against the door jamb and there is often an appreciable crack or clearance between the side of the door and the door stop piece 16. For this reason, an unscrupulous person can easily open a spring bolted door of this type as the bolt of a lock associated with a door knob 21 has a bevelled face and if a tool, thin sheet or blade of metal is pushed into the clearance between the door and door jamb it will move through the clearance, reach the bevelled face of the bolt and force it back into the lock so that the door may be opened.

In accordance with this invention, a novel door or panel locking means is provided which comprises a hinge like structure the leaf type plates of which are fastened one to the opening edge of the panel or door and the other to the door jamb. When the door is closed the plates are so mounted that the lugs 15 and 16 of each of the plates coaxially align to receive therethrough the bolt, stud or pin 19. The insertion of pin 19 locks the door to the jamb.

Figure 10:
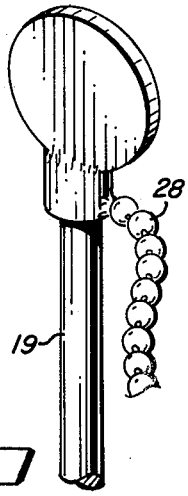
FIG. 10 is an enlarged view of the stud pin shown in FIG. 9 for interlocking the leaf type plates together.

A holder 22 comprising, as shown in FIG. 9, an open ended cylinder 23 fastened to a plate 24, may be held to one of the plates 13 or 14 of the locking means by a screw 25 extending through an aperture 26 in plate 24 and one of the regular apertures 27 spacedly arranged in each of the plates 13 and 14. As shown in FIGS. 9 and 10, pin 19 may be provided with a chain 28 fastened at one end to pin 19 and the other end to holder 22 to keep the pin at all times fastened to one of the plates of the locking means and accordingly, immediately available.

Figure 3:
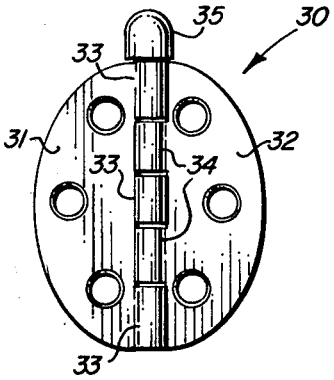
FIG. 3–5 illustrate modifications of leaf type plates shown in the locking mechanism of FIGS. 1 and 2.
Figure 4:
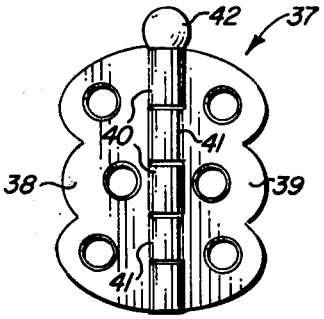
Figure 5:
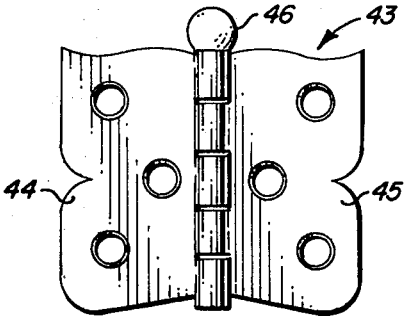

FIGS. 3–5 illustrate further design configurations of other leaf type plates employing the same characteristics of the locking means 12 shown in FIGS. 1–2 and 9.

In FIG. 3 the locking means 30 employs apertured curved leaf type plates 31 and 32 formed with ears or lugs 33 and 34 for accepting in the same manner as the locking means 12 of FIGS. 1, 2 and 9, the pin 35.

FIG. 4 discloses a further modification showing a locking means 37 comprising apertured scalloped edge leaf type plates 38 and 39, the ears or lugs 40 and 41 of which cooperate to receive in an interlocking arrangement a pin 42.

FIG. 5 discloses a still further modification 43 illustrating apertured leaf type plates 44 and 45 each provided with ears or lugs for receiving in coaxial alignment a pin 46.

FIGS. 6–8 illustrate various ways of attaching the locking means disclosed in FIGS. 1–5, 9 and 10 to the panel or door and its door jamb.

In FIG. 6, the leaf type plates of the locking means, which may be for example locking means 12, is fastened with its leaf type plate 13 to the inside surface of door 11 and its leaf type plate 14 to the surface of the molding 11A′ forming a part of door jamb 11.

FIG. 7 illustrates the locking means having its plate 14 fastened to the inside surface 11B of door jamb 11 thereby concealing it in door closed position.

FIG. 8 illustrates a further mounting arrangement of the locking means disclosed in the various figures of the drawing wherein both plates of the locking means such as plates 13 and 14 are secured to the juxtapositioned edges 10A of door 10 and edge 11B of door jamb 11 thereby concealing the locking means except for its pin 19 and lugs 15 and 16.

Thus, a simple, inexpensive and highly effective locking assembly is provided for the latching side of the door which may be added to existing mounted lock structures with little, if any, added expense.

It should be recognized that any leaf plate design may be used and fall within the scope of this invention. For example, the design of FIG. 5 may be used on a door where its attractive appearance adds to the design configuration of the door rather than the straight line configuration of the structure shown in FIGS. 2 and 9. Further, it is intended that a spacing be provided between the ears or lugs of the various leaf interlocking plates of the locking means so that any sagging of the door will not effect the interleaving of the lugs in door closed position.

Although but a few embodiments of the present invention have been illustrated and described, it will be apparent to those skilled in the art that various changes and modifications may be made therein without departing from the spirit of the invention or from the scope of the appended claims.

What is claimed is:

1. A locking mechanism for the non-hinge side of a door like member pivotally mounted on a jamb comprising;

a pair of apertured metallic plates, one mounted on said door like member and the other mounted on said jamb so as to be juxtapositioned to each other when the door like member is closed, each of said plates having ears extending laterally of their juxtapositioned edges which intermesh and coaxially align to define a bore for receiving a pin, a pin for insertion into said bore to interlock said plates together in door closed position, and chain means attached to one of said plates and said pin for securing said pin thereto when not inserted into said bore formed by the intermeshing ears of said plates, said means further comprising an apertured third plate having an open ended hollow cylinder mounted thereon for receiving and holding said pin when said plates are separated from each other, said third plate being attached to one of said plates by a screw passing through the aligned aperture of said third plate and an aperture in one of said plates.

2. The locking mechanism set forth in claim 1 wherein:

the longitudinal axis of said cylinder is parallel with the longitudinal axis of said bore when said ears are intermeshed.

* * * * *